US006460530B1

(12) United States Patent
Backeris et al.

(10) Patent No.: US 6,460,530 B1
(45) Date of Patent: Oct. 8, 2002

(54) AUTOMATIC BALL DISPENSER FOR MULTIPLE USES

(76) Inventors: Dean A. Backeris, 4104 Butler St.-2nd Floor, Pittsburgh, PA (US) 15201; James Kappernaros, 1205 Powers Run Rd., Pittsburgh, PA (US) 15238; Frank J. Costa, 7 Meadow Park La., Pittsburgh, PA (US) 15215

( * ) Notice: Subject to any disclaimer, the term of this patent is extended or adjusted under 35 U.S.C. 154(b) by 0 days.

(21) Appl. No.: 09/537,437

(22) Filed: Mar. 27, 2000

(51) Int. Cl.[7] ..... F41A 9/61

(52) U.S. Cl. ..... 124/49; 124/50; 124/53; 124/72; 222/367; 221/203; 221/265

(58) Field of Search ..... 124/49, 50, 53, 124/56, 72; 42/55; 273/317.7; 222/367, 368; 221/200, 203, 206, 263, 265, 266

(56) References Cited

U.S. PATENT DOCUMENTS

| | | | | |
|---|---|---|---|---|
| 3,855,988 | * | 12/1974 | Sweeton | 124/50 |
| 4,094,294 | * | 6/1978 | Speer | 124/56 |
| 4,896,646 | | 1/1990 | Kahelin | 124/50 |
| 5,107,820 | * | 4/1992 | Salansky | 124/78 |
| 5,507,271 | * | 4/1996 | Actor | 124/56 |
| 5,887,578 | | 3/1999 | Backeris | 124/49 |
| 6,374,819 | * | 4/2002 | Ming-Hsien | 124/49 |

* cited by examiner

*Primary Examiner*—J. Woodrow Eldred

(57) ABSTRACT

A ball feeding device for a for connection to a separate and independent ball propelling machine, such as those used to propel softballs, tennis balls, and baseballs. The preferred embodiment includes a lower chute connected to the feed port of a ball machine. Balls are delivered to the lower chute from a hopper through a feed port comprising of a tumbler casing of a hollow tube formation having an entry hole on its open upper end and a feed hole on its open lower end. The casing has a tumbler hole on its wall leading to the feed port. A tumbler sleeve is positioned in the tumbler hole and axial extends perpendicular to the path of the feed port. The tumbler sleeve has a ring gear around its circumference. The tumbler sleeve also has a semicircular sleeve extension, having an inner and outer wall which extends a predetermined distance into the feed port and obstructs the passage of balls though the port. The upper end of the casing is placed within the exit hole of the hopper. A turnstile ring gear with an upwardly extending angular mixing fin surrounds the entry hole. The lower side of the turnstile ring gear meshes with the tumbler ring gear. As the tumbler sleeve rotates, the turnstile gear ring revolves around the entry hole and the fin mixes the balls, positioning one ball within the entry hole. Meanwhile, the wall of the semicircular sleeve alternately obstructs the entry hole and the feed hole. This alternating obstruction causes a ball or other object which is positioned within entry hole to drop into the feed port when the semicircular sleeve does not obstruct the entry hole, and into the lower chute when said sleeve obstructs the entry hole. The lower chute is sloped downwardly. The ball then rolls down the lower chute to the feeding point of the attached ball propelling machine.

7 Claims, 2 Drawing Sheets

AUTOMATIC BALL DISPENSER FOR MULTIPLE USES

This is a continuation of application Ser. No. 09/537,347 filed Mar. 27, 2000. This patent also relates to a previously filed Patent by the inventors. In U.S. Pat. No. 5,887,578 the inventors disclosed a device which mixes, sorts and feeds ball to a barrel attached to a source of flowing air. The balls were then propelled through the barrel by the source of flowing air. In a Disclosure Document filed with the United States Patent and Trademark Office in Disclosure Document Number 453825 on Mar. 26, 1999 the inventors disclosed another use for the loading device. The loading mechanism disclosed can be used as an apparatus to feed balls to a connected ball propelling machine. Specifically this invention relates an improved method for mixing, sorting and individually loading objects such as balls of various sizes, weights, and materials, which are contained in a hopper, through an opening at the bottom of the hopper, onto a chute below the hopper which is attached to the feed port of a ball projecting machine. In this manner balls need not be placed in a linear formation for feeding to the attached machine. This enables the supply of balls to be randomly placed in the hopper and a greater number of balls to be sorted and loaded within the same space utilized by other devices. It distinguishes itself from the parent patent by not including the barrel or the source of flowing air. It also does not have the claim that the loading mechanism continuously obstructs the flow of air through its feed port. The preferred embodiment of the invention includes a hopper, sorter, and mixer, and dispensing mechanism in which balls randomly placed within the hopper are mixed, sorted and dispensed individually and dropped into the lower chute which is attached to the feed port of a ball propelling device. This device has other uses, including the dispensing of gum balls and other candy or objects for packaging purposes or for retail vending sales purposes.

BACKGROUND—FIELD OF INVENTION

DISCUSSION OF PRIOR ART

Prior art which utilizes mechanical means to feed a single ball from a supply of balls is limited. Prior art requires the balls to be placed in a linear formation along an upwardly inclined upper track or chute above the dispensing mechanism. The dispensing mechanism then lifts the individual balls from the upper track and drops it on a lower track sloped downwardly to the feed port of the ball pitching device. Other models have complicated mixing, sorting, and dispensing mechanisms which are relatively large and expensive for the average consumer. Prior art which automatically sorts and loads balls into ball propelling mechanisms require the balls to be placed in a linear track above the loading mechanism. This limits the number of balls which the feeder can hold to the number which the device fits into a linear formation.

These Methods are Embodied in the Following Inventions i) The Automatic feeder for a ball propelling Machine in U.S. Pat. No. 4,896,646 by Kahelin utilizes a chute angled with respect to gravity containing a linear formation of balls which are individually removed from the track by a pair of hooks which rotate at the lowest end of the track. This device is limited by the number of balls which can be formed in a row. I also requires the operator to individually sort the balls to be placed in the chute.

OBJECTS AND ADVANTAGES

Accordingly, several objects and advantages of the invention are to provide a means for individually sorting and loading balls of various sizes, weights, shapes, and materials, from a bulk supply of balls to the point on entry of a ball propelling device. Each embodiment is simple and can be built or molded of inexpensive hard and lightweight materials such as plastic, metal, steel, resin, or vinyl. It can be assembled quickly, simply and easily by the user. When operational the unit can deliver balls from a bulk supply at various time intervals due to the adjustable speed of the motor rotating the tumbler.

DRAWING FIGURES

NUMERALS IN DRAWINGS

Figure 1:
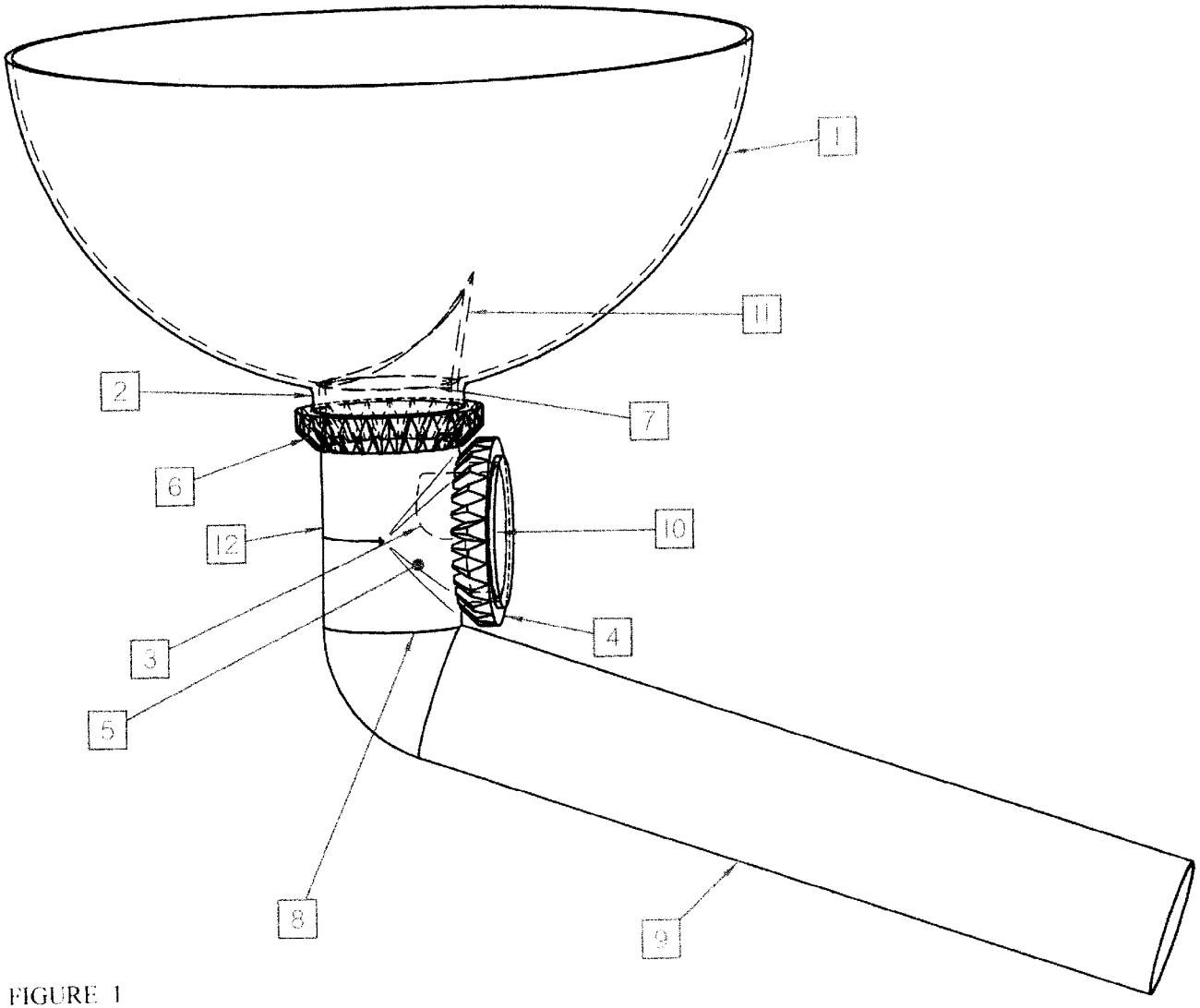
FIG. 1 shows an assembled view of the of the invention.

| | |
|---|---|
| 1. hopper | 2 exit hole |
| 3. sleeve extension | 4 tumbler gear |
| 5 tumbler hole | 6 turnstile gear ring |
| 7 entry hole | 8 feed hole |
| 9 lower chute | 10 tumbler sleeve |
| 11 mixing fin | 12 tumbler casing |

SUMMARY

In accordance with the present invention the preferred embodiment of the ball dispenser has a hopper containing a supply of balls with an exit hole at its lowest point creating a point of exit for the balls. The invention further comprises of a tumbler casing having a hollow round shell formation which has an entry hole on its open upper end, and a feed hole on its open lower end which creates a feed port through the casing and out the feed hole to a lower chute. The lower chute is attached to the feeding point of a ball propelling machine. The entry hole of the tumbler casing is inserted into the exit hole of the hopper creating an exit point from the hopper into the feed port. Inside the hopper and surrounding the entry hole of the tumbler casing is a turnstile ring gear which is capable of rotating around the entry hole. The turnstile ring has an angular mixing fin on its top surface. The undersurface of the turnstile gear ring is a gear. Inside the casing is a tumbler which obstructs the feed port, but which can be moved within the casing. The tumbler comprises of a tumbler ring gear, having a tumbler sleeve axially mounted around its circumference, positioned in the casing and perpendicular to the turnstile gear ring. The gear touches the underside of the turnstile gear ring causing the ring to revolve around the feed and exit holes as the tumbler rotates and the gears mesh. The tumbler sleeve has a semicircular sleeve extension, having an inner and outer wall, of a predetermined arc. The semicircular sleeve extends a predetermined distance into the feed port and blocks a ball from passing through the feed port. Although the sleeve may extend entirely through the feed port and still operate, the sleeve extends only so far as to obstruct the feed port sufficiently for a ball of a predetermined size from passing through the feed port. This permits the feed port to appear visibly open at all times. Although there should be no reason for a persons hand being at or near the feed port while the machine operates, a sleeve of minimal obstruction reduces the likelihood of a person's hand or fingers getting caught in the feed port by the sleeve. For safety reasons the sleeve may have a rounded tip to eliminate sharp pinching corners being formed as the sleeve passes through the feed port. These rounded corners are safer to the person operating the device and are less likely to pinch a finger or to pinch a ball, which would cause the machine to jam.

The tumbler gear is rotated by hand or other means such that the outer wall and inner wall of the sleeve align alternately with the entry hole and the feed hole of the casing and vice versa. During this rotation of the tumbler, the tumbler sleeve prevents more than one ball at a time from passing through the feed port. During this rotation of the tumbler gear the turnstile gear ring revolves the mixing fin, mixing the balls and causing one ball at a time to come to be positioned within the entry hole. When the sleeve is not obstructing the entry hole the ball drops into the feed port and is obstructed from passing through the feed port by the inner wall of the sleeve. The tumbler is then rotated to the point at which outer wall of the sleeve obstructs the entry hole. At this point the ball drops through the feed hole and into the lower chute and rolls to the mouth of the ball propelling machine. Passage of other balls through the feed port is continuously obstructed by the sleeve, so that only one ball at a time may be fed to the attached ball propelling machine.

DESCRIPTION

Figure 2:
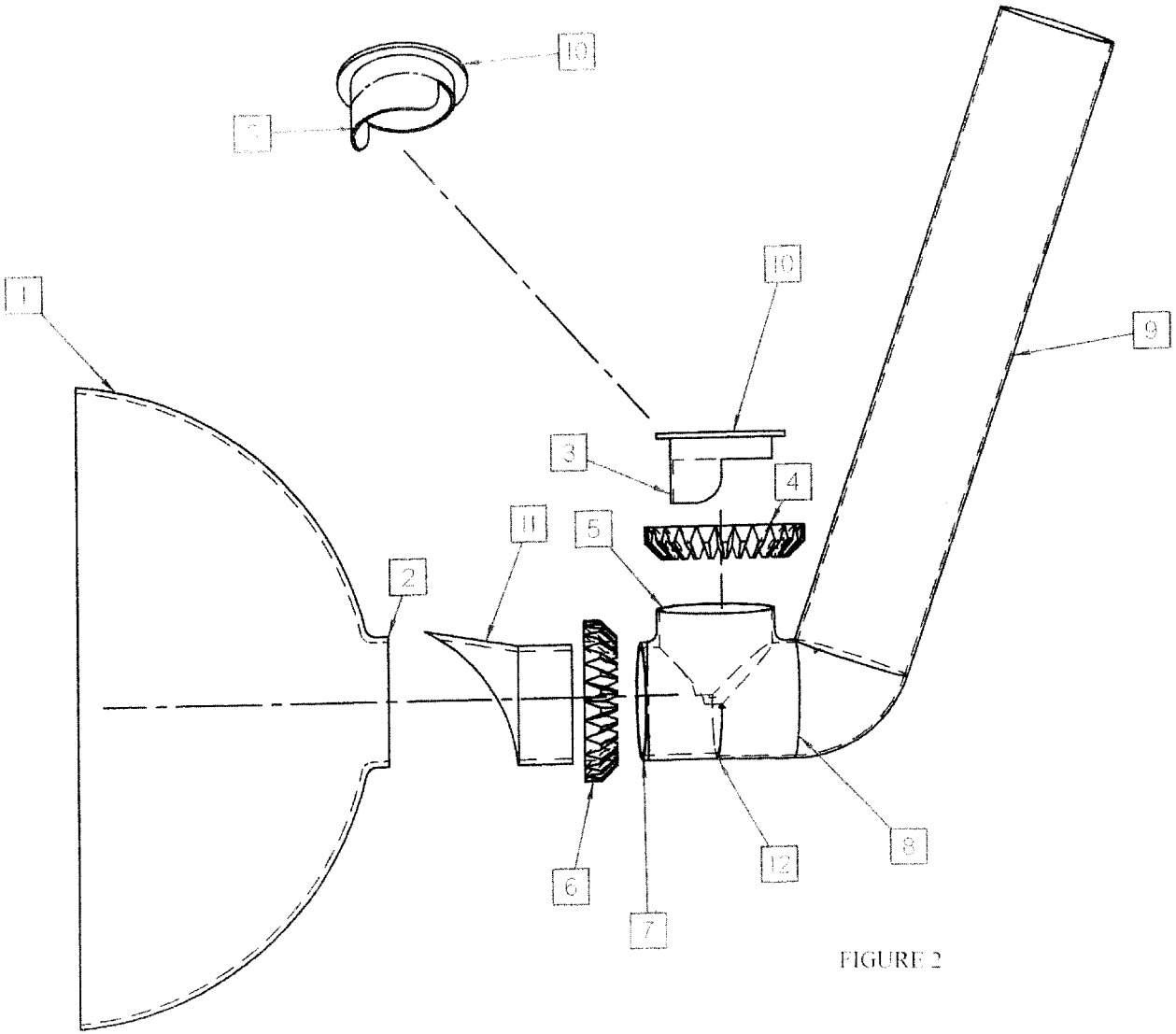
FIG. 2 shows an exploded view of the component parts of the invention.

The typical embodiments of the projection device of the present invention is illustrated in FIGS. 1 through 2.

FIG. 1 shows the preferred embodiment of the machine.

FIG. 2 shows an exploded view of the invention.

The automatic feeder for ball propelling device depicted in the FIG. 1 comprises of a hopper 5 which holds a bulk supply of balls. The hopper replaces the upper chute of other loading devices. It eliminates the limitations of the linear formation requirement of the upper chute and permits many more balls to be supplied to the machine at one time. The hopper has a sloped bottom and an exit hole 2 centered at its lowest point. The tumbler casing 12 is a hollow tube having an open upper end labeled the entry hole 7 and an open lower end labeled the feed hole 8. The upper end of the casing is inserted into the exit hole of the hopper. This assembly creates a path or feed port from the exit hole of the hopper through the casing. Positioned within the hopper, and around the upper end of the tumbler casing, is a turnstile gear ring 6 having and an upwardly extended angular mixing fin 11. The lower surface of the turnstile gear ring is a gear and rotates freely around the upper end. The tumbler casing has a tumbler hole 5 located on its wall. A round tumbler sleeve 10 having an axially extended circular sleeve is inserted in the tumbler hole. The tumbler sleeve has a semicircular sleeve extension 3 around a predetermined distance of its circumference, having an inner wall and an outer wall, which extends into the feed port a predetermined distance. The semicircular sleeve obstructs the feed port from the free passage of a ball. The edge of the tumbler sleeve has a tumbler gear ring 4 which meshes with the underside of the turnstile gear ring causing the ring to revolve around the entry hole as the tumbler rotates. The tumbler gear can be rotated to alternate the sleeve's obstruction of the entry hole and the feed hole. This rotation will feed one ball at a time through the feed port while continuously obstructing other balls from passing through the feed port. As the tumbler revolves by hand or other means, the turnstile gear ring rotates around the entry hole and the mixing fin mixes the balls, positioning one ball within the entry hole. Meanwhile the semicircular sleeve alternately obstructs the feed hole and the entry hole. This alternating obstruction causes a ball or other object which is placed within the entry hole to drop into the feed port when the semicircular sleeve is obstructing the feed hole, and into a lower chute when the sleeve is obstructing the entry hole. The lower chute is sloped downwardly. The ball then rolls down the lower chute 9 to the feeding point of the attached ball propelling machine.

What is claimed is:

1. An automatic feeder for connection between a source of balls and a ball propelling machine comprising of:

(a) a hopper capable of holding a predetermined volume of balls;

(b) an exit hole on the bottom of said hopper;

(c) a means of mixing the balls and separately removing them from the hopper including:

a dispensing mechanism to individually feed balls between the source and the ball propelling machine comprising of tumbler casing of a hollow tube formation, having an entry hole on its open upper end and a feed hole on its open lower end forming a feed port through the tube; said upper end of tube being inserted into the exit hole of the hopper; said tumbler casing having a tumbler hole on its wall; a round tumbler sleeve in with said tumbler hole axially extending into the casing; a semicircular sleeve extension attached to the tumbler sleeve, having an inner and outer wall and extending a predetermined distance into the feed port; said tumbler sleeve having tumbler ring gear circumferencing its outer edge; a turnstile ring gear with a gearlike undersurface surrounding the entry hole of the casing and riding on the edge of the tumbler ring gear; said turnstile ring gear having a mixing means on its upper surface extending into the hopper.

2. An automatic feeder for connection between a source of balls and a ball propelling machine comprising of:

(a) a source for a predetermined supply of balls;

(b) a dispensing mechanism to individually feed balls between the source and the ball propelling machine comprising of a tumbler casing of a hollow tube formation having an entry hole on its open upper end, and a feed hole on its open lower end forming a feed port through the casing; said casing having a tumbler hole on its wall; a round tumbler sleeve in said hole axially extending into to the casing, a semicircular sleeve extension attached to the tumbler sleeve, having an inner and outer wall, and extending a predetermined distance into the feed port.

(c) a revolving means such that as the tumbler sleeve is rotated, balls are individually dispensed from the source of balls through the feed port and into the attached ball propelling apparatus.

3. The tumbler sleeve of claim 2 having a tumbler ring gear circumferencing its outer edge.

4. The ball dispensing machine of claim 2 wherein the supply of balls comprises of a hopper having an exit hole at its bottom positioned around the entry hole of said tumbler casing; a turnstile ring gear positioned perpendicular to the tumbler ring gear and surrounding said entry hole; said turnstile ring gear having a gear on its undersurface and with its outer edge resting on the tumbler ring gear such that as the tumbler ring gear is rotated the turnstile ring gear is revolved by the meshing gears, and the balls are mixed by a semicircular angular fin vertically extending from the circumference of the turnstile gear ring, causing the balls to be positioned within the entry hole to be dispensed by the rotating tumbler through the feed port and into the attached ball propelling machine.

5. An automatic feeder for connection between a source of balls and a ball propelling machine comprising of:

(a) a source for a predetermined supply of balls;

(b) a dispensing mechanism to individually feed balls between the source and the ball propelling machine comprising of a tumbler casing of a hollow tube formation having an entry hole on its open upper end, and a feed hole on its open lower end forming a feed port through the casing; a round tumbler sleeve in said casing axially extending into to the casing perpendicular to the path of the feed port, a semicircular sleeve extension attached to the tumbler sleeve, having an inner and outer wall, and extending a predetermined distance into the feed port.

(c) a revolving means such that as the tumbler sleeve is rotated, balls are individually dispensed from the source of balls through the feed port and into the attached ball propelling apparatus.

6. The tumbler sleeve of claim 5 having a tumbler ring gear circumferencing its outer edge.

7. The ball dispensing machine of claim 5 wherein the supply of balls comprises of a hopper having an exit hole at its bottom positioned around the entry hole of said tumbler casing; a turnstile ring gear positioned perpendicular to the tumbler ring gear and surrounding said entry hole; said turnstile ring gear having a gear on its undersurface and with its outer edge resting on the tumbler ring gear such that as the tumbler ring gear is rotated the turnstile ring gear is revolved by the meshing gears, and the balls are mixed by a semicircular angular fin vertically extending from the circumference of the turnstile gear ring, causing the balls to be positioned within the entry hole to be dispensed by the rotating tumbler through the feed port and into the attached ball propelling machine.

* * * * *